US006101649A

United States Patent [19]

Wu

[11] Patent Number: 6,101,649

[45] Date of Patent: Aug. 15, 2000

[54] MECHANIZED FOLDABLE BED

[75] Inventor: Jack Wu, Taipei, Taiwan

[73] Assignee: Modas Shing Co. Ltd., Taipei, Taiwan

[21] Appl. No.: 09/338,394

[22] Filed: Jun. 22, 1999

[51] Int. Cl.[7] ..... A61G 7/015; A61G 7/018

[52] U.S. Cl. ..... 5/618; 5/616

[58] Field of Search ..... 5/618, 616, 617, 5/613, 174

[56] References Cited

U.S. PATENT DOCUMENTS 4,349,924 9/1982 Zur ..... 5/618

4,821,351 4/1989 Bergenwall ..... 5/618

6,006,379 12/1999 Hensley ..... 5/616

*Primary Examiner*—Alexander Grosz

*Attorney, Agent, or Firm*—Thorp Reed & Armstrong, LLP

[57] ABSTRACT

A mechanized foldable bed is disclosed. The foldable bed has a front frame assembly and a rear frame assembly pivotal with respect to the front frame assembly. A motor is securely mounted under the bed, a driving rod driven by the motor, a first connecting rod is pivotally connected with the driving rod, a second connecting rod is pivotally connected with the first connecting rod and a third connecting rod connected with the second connecting rod. A tube securely mounted under the bed is for receiving the second connecting rod therethrough.

3 Claims, 5 Drawing Sheets

MECHANIZED FOLDABLE BED

BACKGROUND OF THE INVENTION

1. Field of the Invention

The present invention relates to a mechanized foldable bed, and more particularly to the structure that provides substantial support to a user lying on the bed. The structure uses a single motor and a series of linkages pivotally connected with the motor so as to alternatively provide support to the torso and legs of the user.

2. Description of Related Art

A lot of patents addressing the function and structure of a bed for hospital patients are available to the public. Functionally, these beds all have one thing in common, that is to provide support to the torso and legs of a patient lying thereon. Normally, a foldable bed used for a patient has a handle, a shaft connected with the handle and a plurality of linkages pivotally connected with the shaft. When the handle is rotated, the shaft with thread formed thereon will be driven to rotate in the same direction as the handle. The rotation of the shaft will thus drive the rear portion and/or the front portion of the bed and cause them to be lifted upward. Because of the movement of the rear portion and the front portion of the bed, the torso and legs of the patient will be inclined upwardly either separately or simultaneously. The above mentioned structure can provide substantial support to the torso and legs of the patient. However, the operation of this type of bed requires that a person not in the bed manually turn the handle to adjust the bed. To rectify this shortcoming, a new structure was developed that has at least one motor mounted thereunder, so that the upward movement of the front and/or rear portion of the bed is driven by the motor that can be operated by the patient in the bed. The conventional mechanized bed increases the efficiency of providing support to the patient, however it is complex in structure and expensive.

The present invention aims to provide an improved a mechanized foldable bed to obviate and/or mitigate the aforementioned problems.

SUMMARY OF THE INVENTION

The main object of the present invention is to provide a mechanized foldable bed. The structure of the bed enables the utmost rear portion of the bed to move obliquely or horizontally, so as to provide substantial support to the legs of a patient lying thereon.

Therefore, the patient lying on the bed constructed in accordance with the present invention not only has substantial support to the torso and/or legs but is also moved smoothly while the rear portion of the bed is lifted upward.

In order to meet the above objectives, the foldable bed has a front frame assembly composed of a first frame member and a second frame member pivotally connected with the first frame member and a rear frame assembly composed of a third frame member and a fourth frame member pivotally connected with the third frame member. Furthermore, the foldable bed has a motor, a driving rod extendably connected with the motor, a first connecting rod pivotally connected with the driving rod, a second connecting rod pivotally connected with the first connecting rod and a tube securely mounted under the rear frame assembly to receive the second connecting rod therethrough. The first frame member has a first connector securely connected thereunder and pivotally connected with the driving rod. The third frame member has a second connector securely connected thereunder and pivotally connected with the free end of the driven rod. When the motor is activated, the driving rod extends or retracts and the first and the second connecting rods will move accordingly, and the first frame member and the third frame member will be moved. Due to the movement of the first and third frame members, the torso and legs of the patient lying on the bed will be supported to move along with the first and the third frame members. Furthermore, a transverse rod is securely provided in the rear frame assembly to be pivotally connected with at least one link whose free end is pivotally connected with the free side of the fourth frame member. Therefore, when the third frame member is lifted upward due to the driving of the motor by means of the second connector, the fourth frame member is able to be lifted upward horizontally. Thus, the legs of the patient are able to be lifted upward without bending.

Another objective of the invention into provide at least one roller on the free side of the fourth frame member whereby when the pivotal connection between the link and the free side of the fourth frame member is detached, and when the third frame member is activated by the driving of the motor, the fourth frame member is able to obliquely slide on a support mounted on the rear frame assembly.

The detailed features of the present invention will be apparent in the detailed description with appropriate reference to the accompanying drawings.

DETAILED DESCRIPTION OF PREFERRED EMBODIMENT

Figure 1:
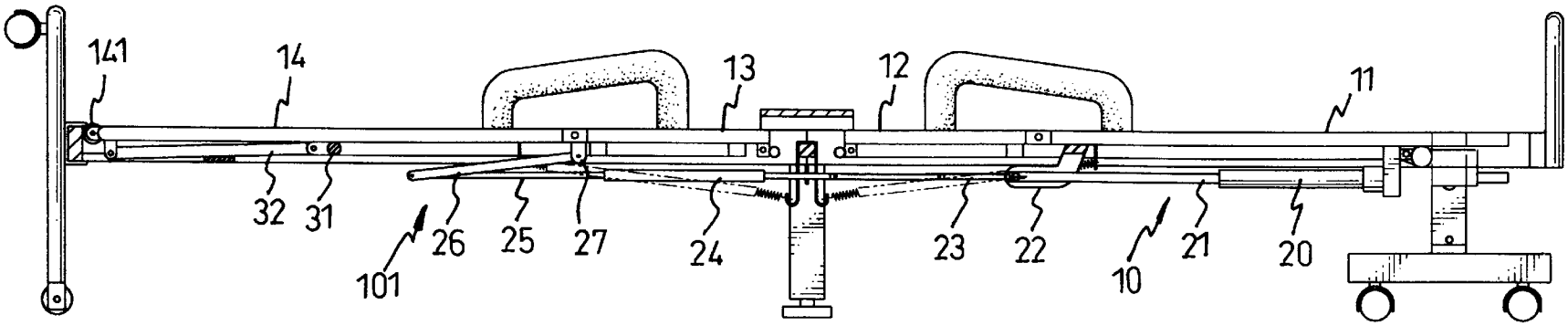
FIG. 1 is a side view showing the linkage of a mechanized foldable bed constructed in accordance with the invention.
Figure 2:
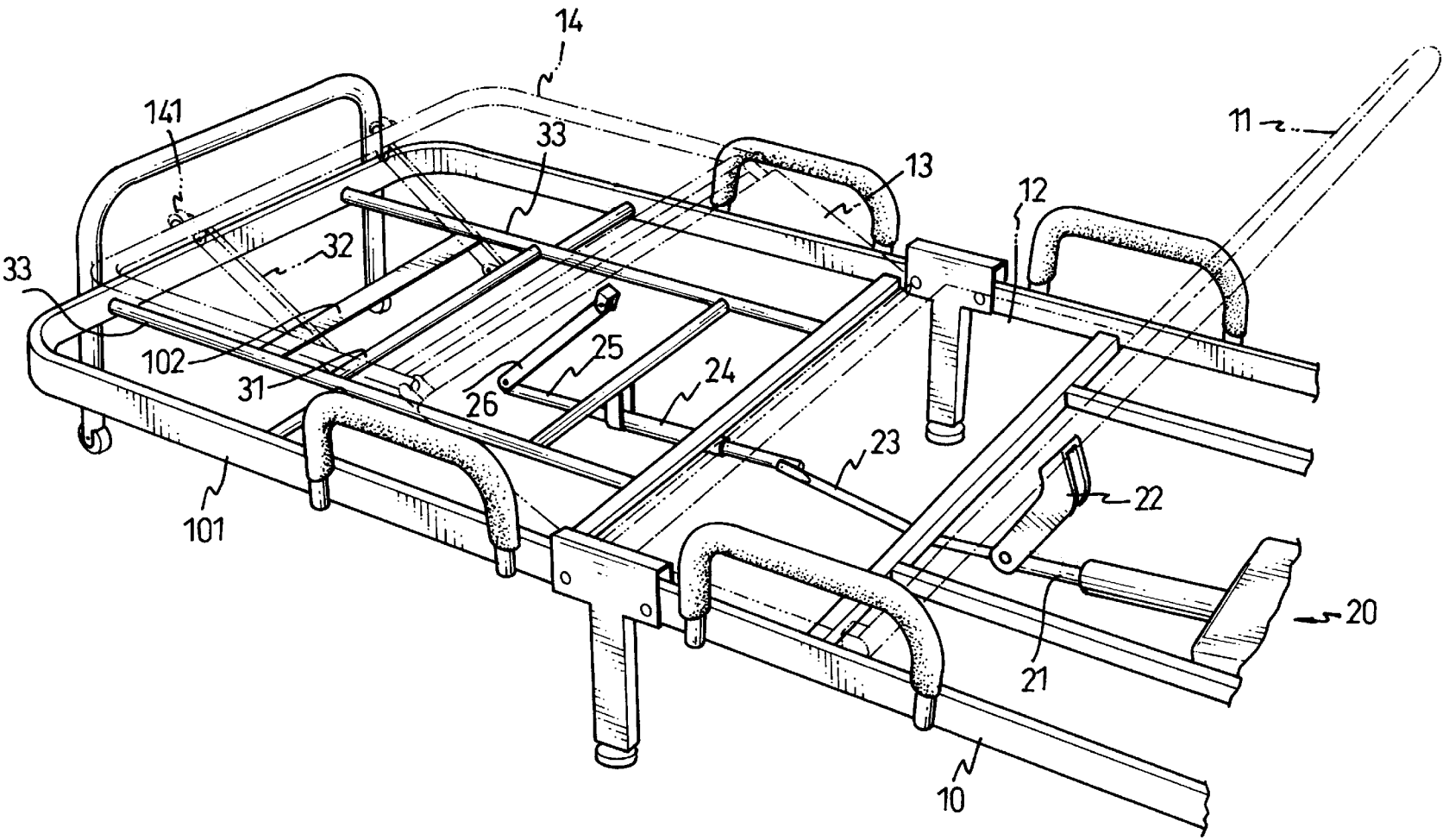
FIG. 2 is perspective view in partial showing the movement of the frame members due to the driving of the motor mounted under the bed of the invention.

The present invention relates to a mechanized foldable bed. Referring to FIGS. 1 and 2, the foldable bed has a front frame assembly (10) composed of a first frame member (11) and a second frame member (12) pivotally connected with the first frame member (11) and a rear frame assembly (101) composed of a third frame member (13) and a fourth frame member (14) pivotally connected with the third frame member (13). Furthermore, the foldable bed has a motor (20) mounted under the front frame assembly (10), a driving rod (21) extendably connected with the motor (20), a first connecting rod (23) pivotally connected with the driving rod (21), a second connecting rod (25) pivotally connected with the first connecting rod (23), a tube (24) securely mounted under the rear frame assembly (101) for receiving the second connecting rod (25) therethrough and a third connecting rod (26) pivotally connected with the free end of the second connecting rod (25). The first frame member (11) has a first connector (22) securely connected thereunder and pivotally connected with the driving rod (21). The third frame member (13) has a second connector (27) securely connected thereunder and pivotally connected with the free end of the third connecting rod (26).

One end of the first connector (22) is securely connected under the first frame member (11) and the other end thereof is pivotally connected with the driving rod (21), such that when the driving rod (2 t) extends or retracts by the motor (20), the first frame member (11) is able to move obliquely upward or downward with respect to the second frame member (12). Because of the pivotal connection between the first connecting rod (23) and the second connecting rod (25) and the limitation of the tube (24), the second connecting rod (25) is able to initiate the inclined movement of the third frame member (13) with respect to the fourth frame member (14) when the connection between the third connecting rod (26) and the second connecting rod (25) is fixed.

It is noted from FIG. 2 that a transverse rod (31) is firmly fixed to the rear frame assembly (101) to be pivotally connected with at least one link (32) whose free end is pivotally connected with the free side of the fourth frame member (14). Therefore, when the third frame member (13) is lifted upward due to the driving of the motor (20) by means of the second connector (27), the fourth frame member (14) is able to be lifted upward horizontally. Thus, the legs of the patient are able to be lifted upward without bending, which benefits the patient suffering from leg joint injury.

Figure 3:
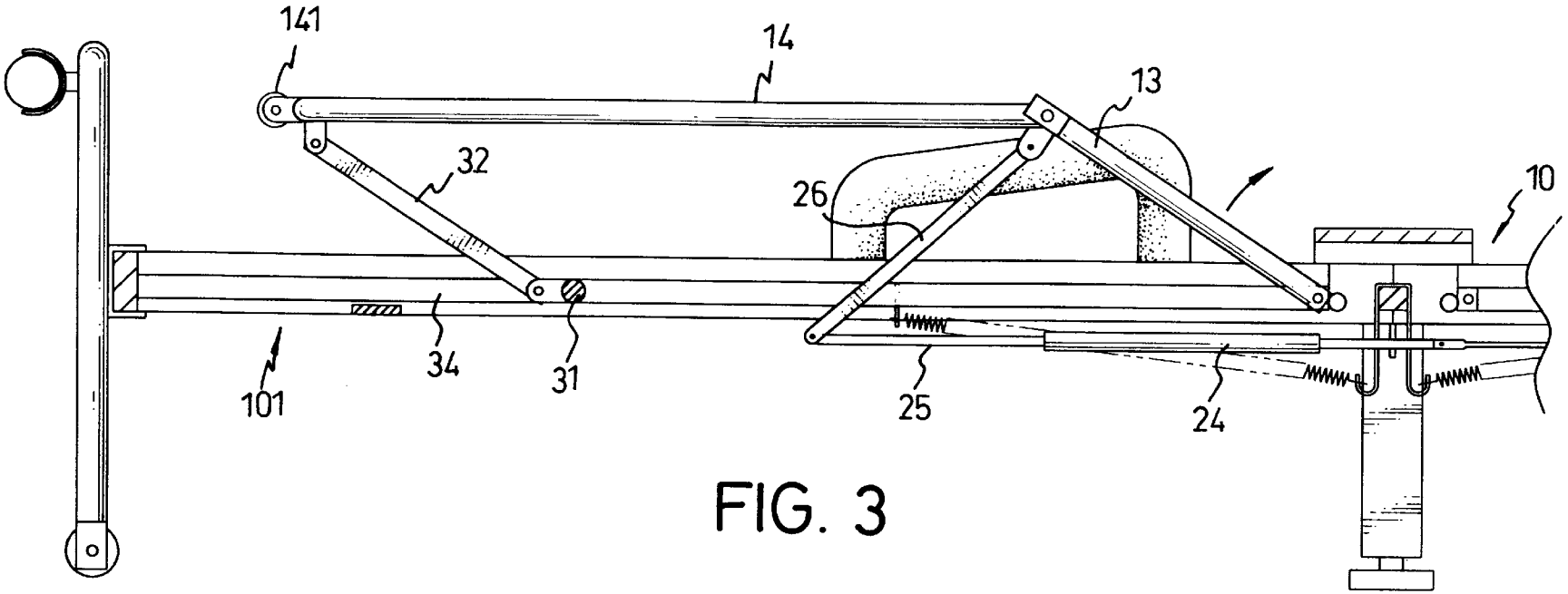
FIG. 3 is a plan view showing the relative movement of the third and the fourth frame members by the driving of the linkage of the invention.
Figure 4:
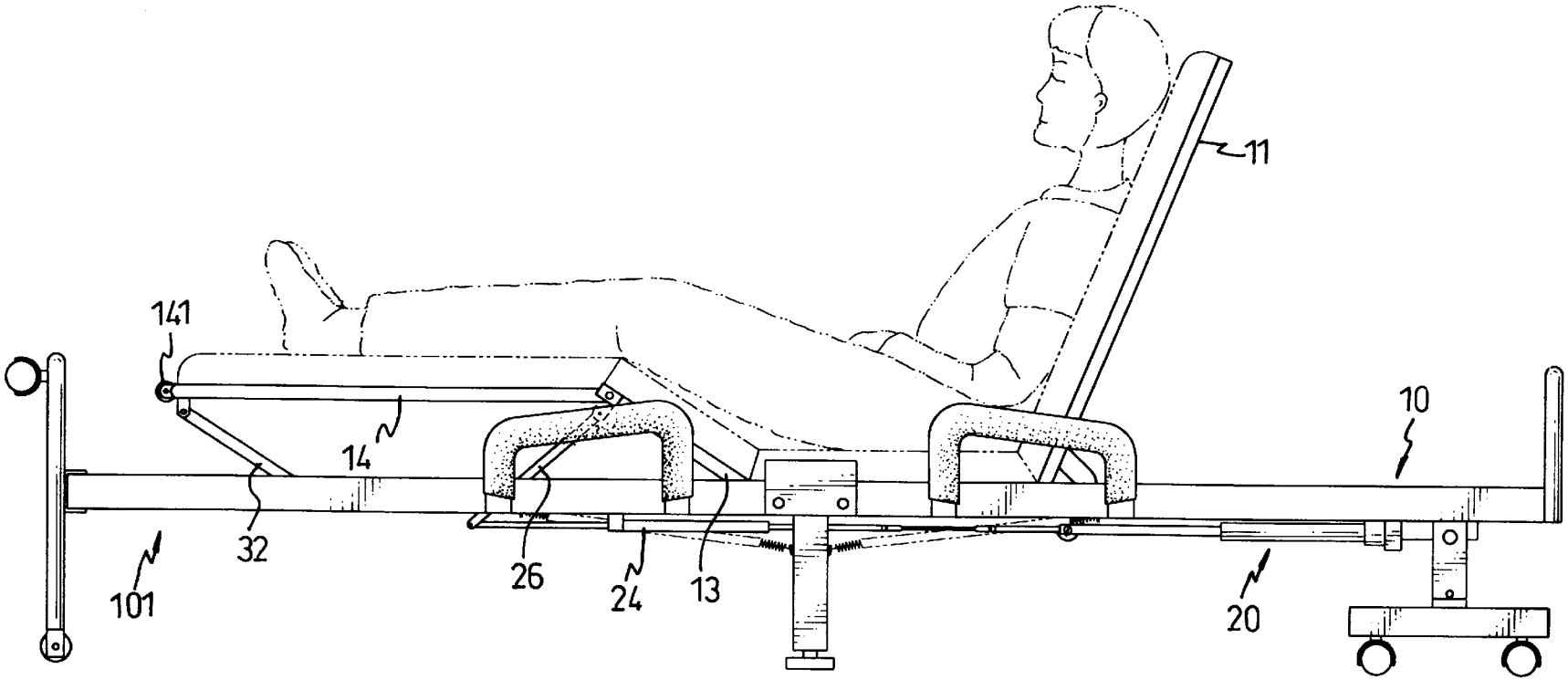
FIG. 4 shows an application of the bed, wherein the third frame member is obliquely lifted upward and the fourth frame member is horizontally lifted.
Figure 5:
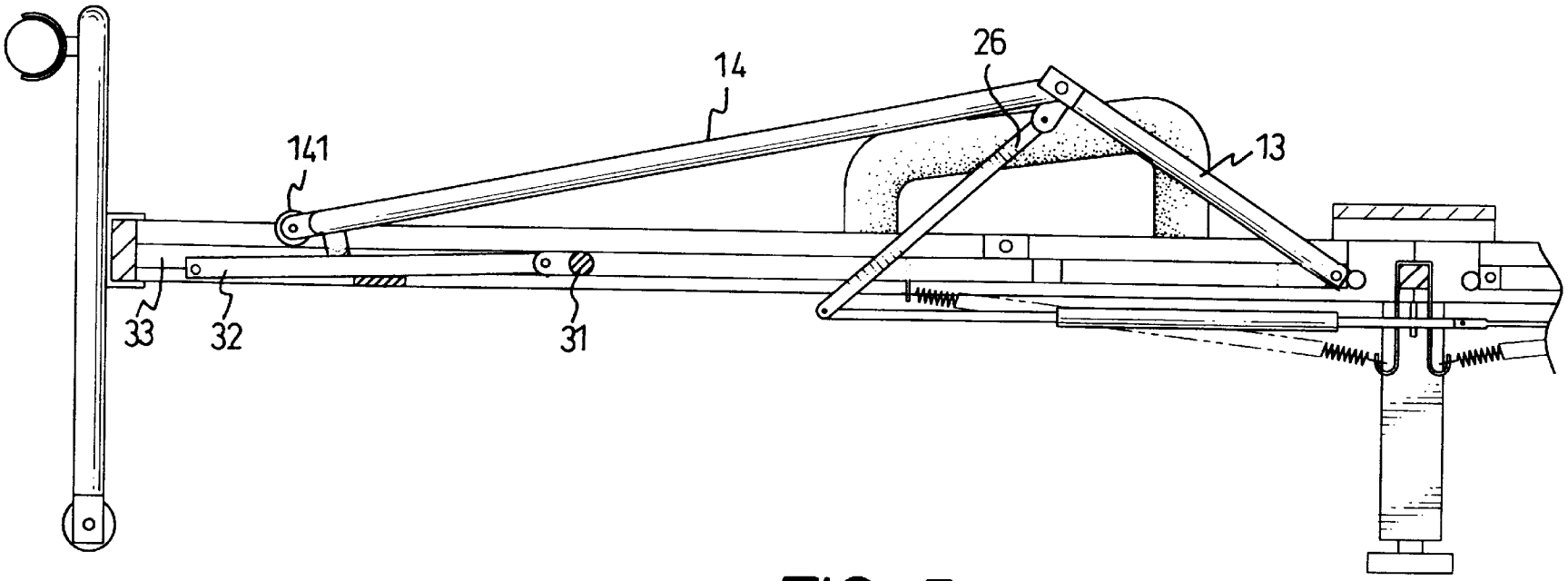
FIG. 5 is a side view showing another embodiment of the invention, wherein the pivotal connection between the link and the free side of the fourth frame member is detached.

Referring to FIG. 3, when the third frame member (13) is lifted obliquely because of the actuation of the third connecting rod (26), because the pivotal connection between the third frame member (13) and the fourth frame member (14) and the connection relationship between the link (32) and the fourth frame member (14), the fourth frame member (14) is moved upward horizontally. With such an arrangement, the patient is able to lie on the bed of the invention with his/her legs lifted horizontally as shown in FIG. 4.

Furthermore, referring to FIGS. 1 to 5, at least one roller (141) is rotatably provided on the free side of the fourth frame member (14) and at least one track (33) is firmly formed under the rear frame assembly (110) to correspond to the at least one roller (141). The track (33) is provided vertically with respect to the transverse rod (31) and the at least one roller (141) is able to rotatably move along the track (33). Therefore, when the pivotal connection between the link (32) and the free side of the fourth frame member (14) is detached, the lifted movement of the third frame member (13) will simultaneously drive the fourth frame member (14) to move due to the pivotal connection therebetween. However, because the pivotal connection between the link (32) and the fourth frame member (14) is detached, the at least one roller (141) will move on the track (33) and the fourth frame member (14) will then move obliquely with respect to the rear frame assembly (101).

It is concluded that the mechanized foldable bed of the invention has the following advantages:

1. The fourth frame member (14) is able to be obliquely or horizontally lifted upward with respect to the third frame member (13), the patient lying of the bed is able to choose what type of upward movement to be used depend on the physical condition.

2. The horizontal or oblique movement of the fourth frame member requires no additional driving device to accomplish two different lifts.

3. By means of simple mechanical connection, the bed easily fulfills the requirements of the patient.

4. Simple structure.

5. Un-expensive and labor effective.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What claimed is:

1. A mechanized foldable bed structure having a front frame assembly (10) composed of a first frame member (11) and a second frame member (12) pivotally connected with the first frame member (11) and a rear frame assembly (101) composed of a third frame member (13) pivotally connected with the second frame member (12) and a fourth frame member (14) pivotally connected with the third frame member (13), the structure comprising:

a motor (20) securely mounted under the bed;

a driving rod (21) extendably connected with the motor (20);

a first connecting rod (23) pivotally connected with the driving rod (21);

a second connecting rod (25) pivotally connected with the first connecting rod (23);

a tube (24) securely mounted under the bed for receiving the second connecting rod (25) therethrough;

a third connecting rod (26) whose first end is pivotally connected with the second connecting rod (25);

a first connector (22) securely connected under the first frame member (11) and pivotally connected with the driving rod (21);

a second connector (27) securely connected under the third frame member (13) and pivotally connected with a second end of the third connecting rod (26);

a transverse rod (31) firmly and transversely mounted under the rear frame assembly (101); and a link (32) whose first distal end is pivotally connected with the transverse rod (31) and whose second distal end is pivotally connected with the free side of the fourth frame member (14);

whereby the fourth frame member (14) is able to horizontally move with respect to the bed.

2. The structure as claimed in claim 1, wherein the connection between the link (32) and the free side of the fourth frame member (14) is detachable.

3. The structure as claimed in claim 2 further comprising at least one roller (141) rotatably mounted on the free side of the fourth frame member (14) and at least one track (33) provided to the rear frame assembly (101) and corresponding to the at least one roller (141), such that the roller (141) is able to rotatably move along the track (33).

* * * * *